US007203984B2

(12) United States Patent
Gardner et al.

(10) Patent No.: US 7,203,984 B2
(45) Date of Patent: Apr. 17, 2007

(54) MEDICAL APPARATUS FOR RELIEF OF PAIN

(76) Inventors: Andrew Gardner, The Mill House, Halberton, Tiverton, Devon, EX16 7AG (GB); Arthur M. Newson Gardner, The Priory, Ipplepen Newton Abbot, Devon, TQ12 5RT (GB)

( * ) Notice: Subject to any disclaimer, the term of this patent is extended or adjusted under 35 U.S.C. 154(b) by 0 days.

(21) Appl. No.: 10/494,564

(22) PCT Filed: Nov. 7, 2002

(86) PCT No.: PCT/GB02/05034

§ 371 (c)(1),
(2), (4) Date: Jul. 19, 2004

(87) PCT Pub. No.: WO03/039325

PCT Pub. Date: May 15, 2003

(65) Prior Publication Data

US 2004/0260217 A1 Dec. 23, 2004

(30) Foreign Application Priority Data

Nov. 7, 2001 (GB) ..... 0126762.4
Dec. 4, 2001 (GB) ..... 0129028.7

(51) Int. Cl.
*A47C 27/10* (2006.01)

(52) U.S. Cl. ..... 5/644; 5/713; 5/715; 5/655.3

(58) Field of Classification Search ..... 5/640, 5/644, 645, 655.3, 713, 715
See application file for complete search history.

(56) References Cited

U.S. PATENT DOCUMENTS 3,795,021 A * 3/1974 Moniot ..... 5/644
4,175,297 A * 11/1979 Robbins et al. ..... 5/284
5,121,512 A * 6/1992 Kaufmann ..... 5/713
5,184,365 A * 2/1993 Stafford ..... 5/632
5,277,474 A * 1/1994 Hannagan et al. ..... 297/284.1
5,394,577 A * 3/1995 James et al. ..... 5/713
5,771,514 A 6/1998 Wilhoit
5,963,997 A * 10/1999 Hagopian ..... 5/654
6,370,716 B1 * 4/2002 Wilkinson ..... 5/715
7,007,330 B2 * 3/2006 Kuiper et al. ..... 5/715

FOREIGN PATENT DOCUMENTS

DE 2446935 4/1976
GB 2328866 3/1999

* cited by examiner

*Primary Examiner*—Michael Trettel
(74) *Attorney, Agent, or Firm*—Connolly Bove Lodge & Hutz LLP

(57) ABSTRACT

Medical apparatus (1) for the relief, treatment and/or prevention of neck or back pain comprises a fluid inflatable support pillow (2) and an inflation device (3) connected to the pillow (2) The pillow (2) is adapted for interpositioning between a patient's head and a head rest (24) and supports the neck (23) and sides of the patient's head. The inflation device (3) includes a pump (4) and control means, such as a timer, for controlling the inflation and the deflation of the pillow (2) through a repetitive cycle utilizing two fluid inputs to the volumes of the pillow. Such movement of the patient's occiput (22) gently moves the patient's neck (23) to alleviate or prevent pain.

20 Claims, 5 Drawing Sheets

MEDICAL APPARATUS FOR RELIEF OF PAIN

FIELD OF THE INVENTION

This invention relates to a medical apparatus for the relief of pain and more particularly, though not exclusively, relates to a dynamically inflatable neck or back support pillow for the relief, treatment and prevention of neck pain or back pain.

In this specification any reference to neck pain is to be taken to include reference to back pain.

BACKGROUND OF THE INVENTION

Whiplash injuries and neck pain are a common ailment afflicting many people.

Various supports and pillows for the head, neck and lumbar region are known in the prior art Canadian Patent No. 2099545 describes an adjustable cervical support pillow with an inflatable bolster portion along one edge to fit the contour of the neck U.S. Pat. No. 4,285,081 describes a portable device for recumbency of the head and neck so as to provide support to the user during travelling. British Patent No. 2198341 describes an inflatable neck support pillow of generally U-shaped configuration having rear and side portions for providing rear and lateral support to the head of the user. Other configurations of pillows and head rests are known, for example, from U.S. Pat. Nos. 4,528,705, 4,501,034, 5,271,114 and 4,829,614.

U.S. Pat. No. 4,981,131 describes a method and apparatus for the cyclic mobilization of the lumbar spine through a range of degrees of lordosis to treat back pain.

SUMMARY OF THE INVENTION

The present invention thus aims to provide a medical apparatus which not only relieves neck pain but also treats and/or prevents back/neck pain.

In its broadest aspect, the present invention resides in the application of a periodic inflation and deflation cycle to an inflatable/deflatable support for manipulating the spine of a patient, for example at the head and neck, wherein the support comprises a first, generally central, inflatable volume, one or more other volumes adjoining the central volume on each of three sides thereof and a two channel fluid/supply means connected with the support for controlling periodic cyclic movement of the head with a nodding and/or side-to-side motion by selective inflation/deflation of all said volumes, through the two fluid supply channels.

Advantageously a support in accordance with the invention applies slow passive movement to both prevent and relieve neck/back pain. Such movement is either fore and aft or side-to-side or combined. While such movement is known utilising a three channel inflation/deflation arrangement the present invention achieves the same movements with a two fluid channel inflation/deflation arrangement making the support simpler and cheaper to manufacture.

It can be readily seen from the above that in each of the described embodiments the central part of the pillow is divided into two separate superimposed volumes. Inflation of either of these induces a fore and aft motion of the head. Each of these volumes is connected with a fluid supply channel to one of the side volumes whose function is to induce side-to-side movement of the head. This arrangement enables periodic passive cyclic fore and aft and side-to-side movements to be achieved using only two rather than three supply channels.

The tubes forming the two fluid supply channels that connect one of the central inflatable volumes to one of the side volumes may be provided with standard type directional flow restrictors in order to delay inflation or deflation of the side volumes according to clinical requirements. These channels may be soft plastic tubes that can be selectively occluded by simple clamps to limit inflation/deflation to either central or lateral volumes and hence limit movement to either fore and aft or to side to side motions.

The inflation of these volumes by fluid pump is slow, one to four minutes for example, and the induced movement may be imperceptible. Deflation is by the body weight and the resulting more rapid movement is perceptible and indicates continuing function of the apparatus.

Back/neck pain and stiffness after sitting still in an automobile for example may be the result of failure of lubrication of the various spinal joints. Lubrication is by synovial fluid contained within the joint capsule. The opposing bone surfaces that move relative to each other are covered with articular cartilage that relies on synovial fluid for its nourishment. When immobile, localised pressure points are formed in the articular cartilage and failure of nourishment cause these to become painful. Movement combats this and causes the large GAG protein molecules (Glycos Amino Glycans) in synovial fluid particularly one called Lubricin, to form thin molecular strings that act like roller bearings and facilitate movement between opposing joint surfaces.

According to another, more particular, aspect of the present invention there is provided medical apparatus for the relief of neck pain, the apparatus comprising: a fluid inflatable support pillow having a plurality of interconnected volumes adapted for interpositioning between a patient's head and a head rest; and a source of inflation fluid connected to the pillow, wherein the source includes a two channel input control means for controlling the inflation and the deflation of the pillow in accordance with a periodic cycle so as to move the patient's head cyclically, in a nodding and/or a side-to-side manner by selective inflation/deflation of all said volumes through the said two fluid channels.

The support pillow, in an embodiment of the present invention, is advantageously formed with a plurality of different chambers one or more of which is shaped to provide lateral support to the head of a user and to underlie his neck, and another of which supports the back of the head, and the plural chambers may be variably and selectively inflated using the two fluid channel control means and deflated for cyclically raising and lowering the supported head.

Not only does the abovementioned embodiment of the present invention provide comfort to the user during treatment, as made possible by the lateral support provided to the user's head, but also the iterative inflation and deflation of the pillow, and provided by the two channel fluid supply, applies a gentle pressure to move the neck. This motion provides relief of neck pain and also provides treatment of muscular, skeletal and various other conditions which may be giving rise to the neck pain.

According to a further aspect of the present invention there is provided a method of operating a medical apparatus for providing support for manipulating the spine of a patient, for example at the head and neck, the method comprising providing a fluid inflatable support pillow adapted for interpositioning between a patient's head and a head rest therefor; providing a source of inflation fluid connected to the pillow by two fluid supply channels, and controlling the inflation and deflation of a plurality of volumes of the pillow in accordance with a periodic cycle determined by the two channel fluid control means connected with the said source of inflation fluid so that when the control means is operative the patient's head is moved cyclically in a nodding and/or side-to-side manner by selective inflation/deflation of said volumes, through the two fluid channels.

Yet a further aspect of the present invention resides in the abovementioned aspects but applied to treatment of the lumbar region of the back.

Therefore, there is provided a medical apparatus which not only relieves back/neck pain but also treats and/or prevents back/neck pain by means of slow passive movement of the neck/lumbar regions of the spine in both fore and aft, and side-to-side directions of movement.

The above-described and further features of the present invention are set forth in the appended claims and will be readily understood by consideration of the detailed description hereinafter given with reference to the accompanying drawings.

DETAILED DESCRIPTION OF THE EMBODIMENT

Figure 1:
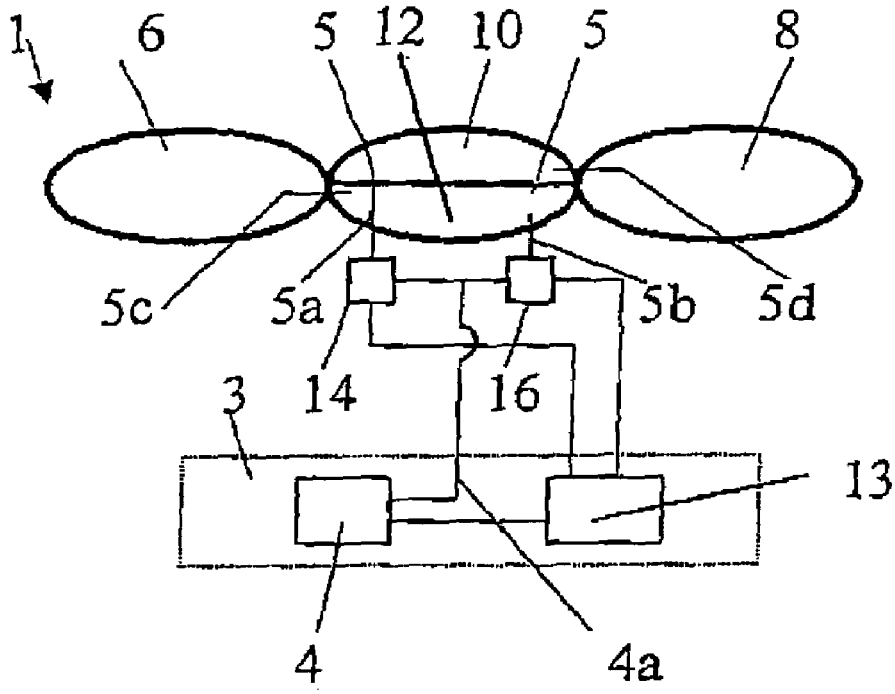
FIG. 1 is a schematic sectional view along line A to A of FIG. 2 of a medical apparatus embodying the present invention including an inflatable neck support pillow.

Throughout the description of the embodiments described herein and in the claims features referred to by number will retain that number throughout and like parts will carry the same reference numerals.

Figure 2:
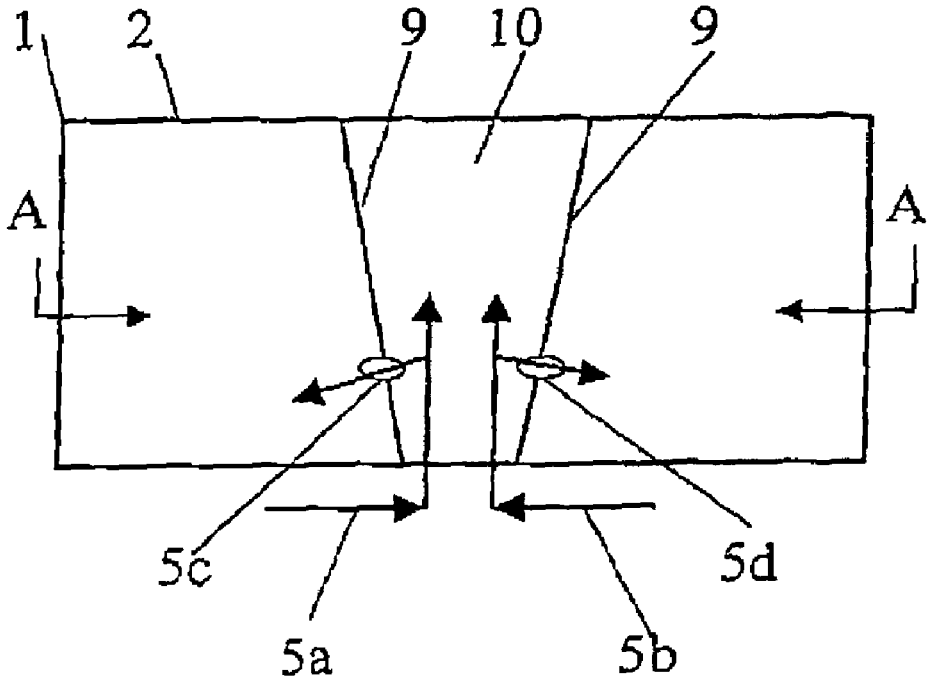
FIG. 2 is a schematic plan view of the inflatable neck support pillow of FIG. 1.

Referring specifically to FIGS. 1 and 2, there is shown a medical apparatus 1 embodying the present invention. The medical apparatus 1 comprises an inflatable neck support pillow 2 of generally rectangular form (FIG. 2) and a fluid inflation device 3 (not shown in FIG. 2). The inflation device 3 comprises a fluid pump 4 having an output 4*a* divided into two paths each coupled by a tubular air pipe 5*a*, 5*b*, with two input/outputs 5*c*, 5*d* respectively, of the pillow. The pump may comprise an adjustable flow compressed air pump for supplying air continuously, which may be a small diaphragm air pump, for example of the type used for aerating aquaria.

The support pillow 2 is shown in each embodiment as though all the volumes are in an inflated condition. However, as will be hereinafter described in more detail only one of the central volumes will be inflated at any given time. Similarly, the side volumes 6, 8 are also inflated/deflated at different times in an operative cycle.

The pillow 2 is formed of overlapping plastics sheets, such as sheets of polyvinylchloride or polyurethane, which are interconnected along welded seams 9 positioned so as to divide the pillow 2 into a plurality of independently fluid inflatable/deflatable compartments referred to throughout this specification as volumes. In FIG. 1 the pillow 2 comprises an inflatable central volume 10, two inflatable side volumes 6, 8 and an additional inflatable central volume 12 located beneath volume 10. The inflatable side volumes 6, 8 each have, when inflated, an oval cross-section as shown in FIG. 1 with the volumes 10, 12 being of a rectangular configuration in plan view, FIG. 2.

The tubular air pipes 5*a*, 5*b*, couple the fluid inflation device 3 to respective ones of the inflatable central 10 and base 12 volumes. The side volumes 6, 8 are inflatable through an air bleed 5*c*, 5*d* through the seams 9 between the central and external volumes. Although referred to as an air bleed 5*c*, 5*d* through the seams 9 these bleeds are small diameter tubes relative to pipes 5*a*, 5*b*, which allow the free flow of fluid, preferably air but may be liquid, between the respective volumes. These tubes can be formed by metal rings which are of a preselected internal diameter for controlling flow rate of fluid therethrough.

The inflation device 3, comprises a fluid pump 4, an electronic timer 13 for controlling the length of an operative cycle and two electronic solenoid control valves 14 and 16, having one channel output each to connect, at an appropriate time in the cycle, the fluid supply with a respective one or more of the volumes 6, 8, 10 and 12. One channel tubular air pipe 5*b* is connected from solenoid valve 14 to volumes 6 and 10 and one channel tubular air pipe 5*a* is connected to volumes 8 and 12. The pump 4 which is electrically operated provides a continuous source of the fluid to the electronically controlled solenoid valves which in turn inflate the volumes 6 and 10 and 8 and 12. The electronic timer 13 has a timed cyclic switching program therein.

The valves 14, 16 may be pneumatic direction valves, or commercially available electronic solenoid valves which are selectively responsive to electrical control signals from the controller 13 to restrict the flow of a fluid, gas or liquid, therethrough, in one direction by increasing resistance to fluid flow and allow venting of the connected volume or to hold an inflated condition. Therefore, once inflated the volumes 6, 8, 10 and 12 can be controlled to remain inflated or can be deflated by switching the respective solenoid valves to a vent position.

The pump 4 is accordingly capable of periodically supplying air to and extracting air out of the central volumes 10, 12 and hence the side volumes 6, 8.

The electrical controller 13 is an electronic timer circuit having a timed cyclic switching program therein to switch the solenoids 14, 16 to allow the individual volumes of the pillow to be inflated/deflated in accordance with the predetermined periodic switching cycle program.

For example, in operation of the pillow of FIGS. 1 and 2 the switching program is arranged so that the inflatable side and central volumes 6, 12 are inflated through valve 16 causing the head to be raised in a nodding action and pushed to the right in FIG. 1. After a predetermined period the electric timer 13 will switch to a second circuit causing the pump to inflate volumes 8 and 12 during which time volumes 6 and 10 will deflate, causing the nodding movement and side-to-side cyclic movement in the opposite direction. After each cycle the head will return to the non inflated rest position. Directional restrictor valves may be inserted in the fluid supply pipes to the volumes 6 and 10 and 8 and 12 so as to reverse the sequence from firstly nodding and then side-to-side movement to side-to-side and then nodding movement.

Such controlled inflations and deflations enable the head of a patient to be moved with a side-to-side movement and with nodding movement as the central volume 10 is inflated/deflated after each cycle of side-to-side movement. The central volumes 10, 12 are inflated/deflated alternatively. The input/outputs 5*c*, 5*d* between the volumes 10, 8 and 12, 6 each preferably comprise a pipe ring. Air bleed slits may be provided in place of the pipes 5*c*, 5*d* but have the disadvantage of being far less efficient than the use of metal or plastics rings with preselected aperture sizes to control the flow of fluid therethrough.

The compressed air pump 4 may be replaced by any suitable supply of fluid (gas or liquid) for inflating the pillow 2. Any such alternative fluid supply would, however, require the additional provision of a reservoir for storing the fluid. Advantageously, no such reservoir is required with the compressed air pump 4 used in the present embodiment.

The central volumes 10, 12 in the embodiment of FIGS. 1, 2, once inflated, take an oval shape as do the side volumes 6, 8. The shape of these volumes may be determined by the material used to formulate the external covering defining the volumes. Alternatively, the volumes particularly the central volumes, can be provided with height restrictors as shown at 20 in FIGS. 3 and 4 and which are described in detail below with reference to FIGS. 3 and 4.

Although not shown the pillow 2 can be adjustably securable to a head rest, for example a bed mattress, by means of a strap.

Figure 3:
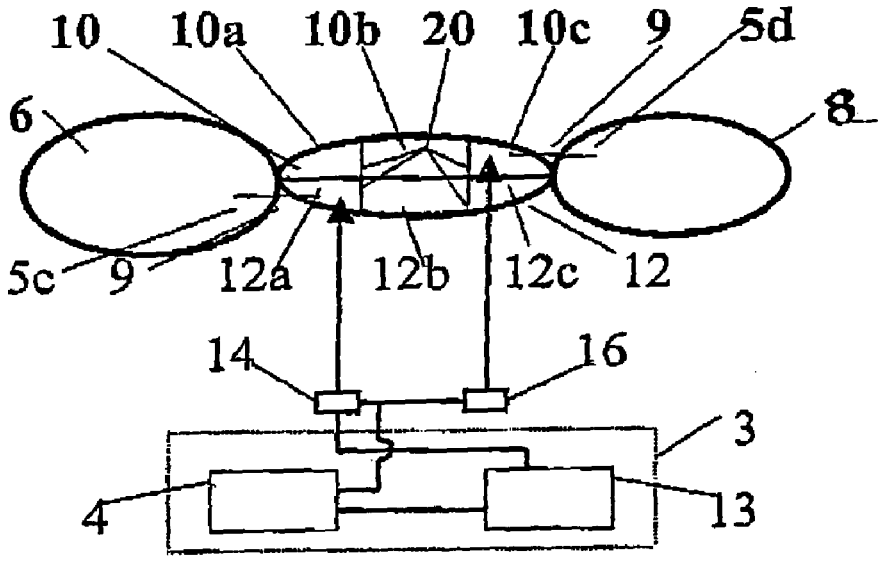
FIG. 3 is a schematic cross-sectional view of an inflatable back pillow of FIG. 4.
Figure 4:
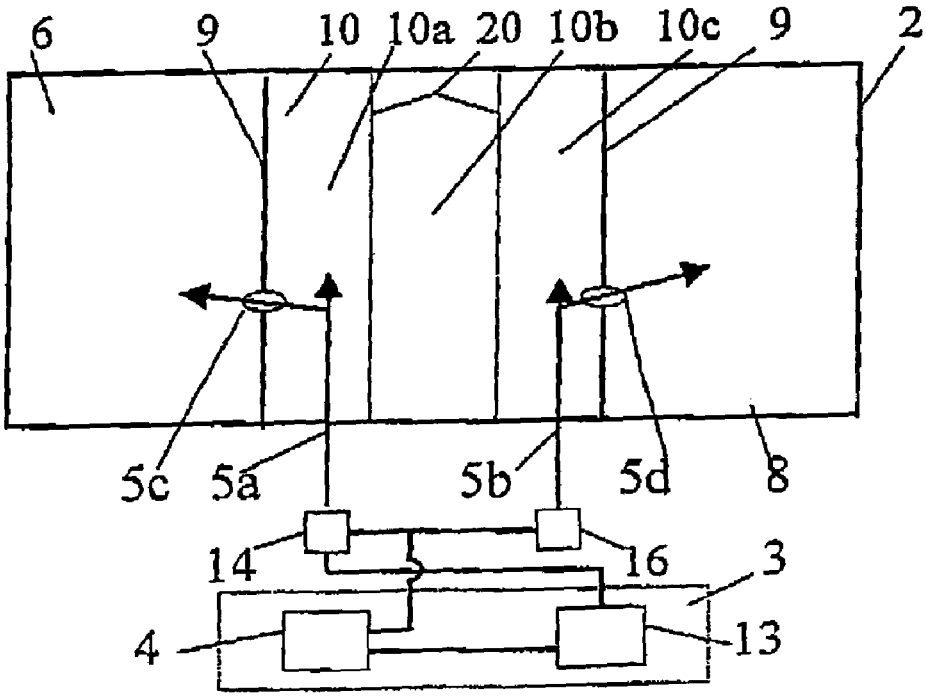
FIG. 4 is a schematic plan view of the support pillow of FIG. 3.

FIGS. 3 and 4 are more detailed schematic views of one alternative embodiment of the pillow 2 of FIG. 1 which is constructed and is operable in a similar manner to that described for the pillow of FIGS. 1, 2 and its operation will not be further described in detail. However, the pillow in this embodiment is provided with sides 6, 8 and central volumes 10, 12 which each have welded seams 9 along two or more of their edges, and linear height restrictors 20 located within each central volume to divide each central volumes 10, 12 into three internally interconnected compartments or sub-volumes 10*a*, 10*b*, 10*c* and 12*a*, 12*b*, 12*c* which can all be filled with air through a single inlet 5*a* or 5*b*, respectively. As previously described with reference to FIG. 1, air is supplied to the pillow 2 through the two inlets 5*a*, 5*b* so as to variably inflate/deflate each of the central, side and base volumes 6, 8, 10, 12. The height restrictors 20 which are provided between respective opposed faces of the central volumes limit the extent of inflation of the central volumes 10, 12.

The height restrictors 20 provided in each of the central volumes 10, 12 restrict the height to which the central volumes can be inflated. However, the height restrictor structure is such as to allow the free movement of fluid between the sub-volumes formed thereby, so that either volume 10, 12 operates as one single volume. Movement of the central volume 10 caused by the inflation/deflation cycle serves to slowly and gently lift and support the neck/back of a patient.

The rectangular planar form of the pillow 2 is suitable but not critical for working the invention as shown by the embodiment of FIGS. 1 and 2. It would be possible for the invention to be applied to a circular or other shaped pillow so long as the pillow was appropriately sectioned. The pillow 2 may, as previously described, be made from polyvinylchloride or polyurethane. However, various other types of plastics material or even rubber could be used instead Furthermore, it is to be noted that the invention may be used for treatment of patients in a lying or seated position. For example, the pillow 2 of the above described embodiments may be used with a bed mattress or the back of a seat, for example in a vehicle seat.

As previously mentioned, whilst the inflation and deflation of the pillow may be designed to move the patient's head only in a nodding fashion, it is readily possible, by appropriate modification of the inflation and deflation arrangement, additionally or alternatively to provide a side-to-side and/or fore and aft movement of the patient's head. The side-to-side rocking movement can be achieved by repeated cyclic operation according to a preset sequence of inflation and deflation steps applied, for example, to the embodiment of FIG. 1 or 2 where the volumes 6, 8 are inflated/deflated intermittently in accordance with a periodic cyclic sequence of steps programmed into electric controller 13 while holding the central volume 12 in a substantially inflated condition to continuously support the patient's neck.

The controller 13 is preferably a standard electronic timer control circuitry for controlling the switching of the valves 14, 16 in the manner described herein so as to provide a continuous movement of a patient's neck or back. The order of the cyclic steps can be varied although the specific order of the individual steps just described is preferred to give the most efficient movement of the patient's neck.

The controller referred to herein is a standard time switching circuit of the kind which is well known to a skilled engineer working in this art and therefore is not described in detail other than to say the switching circuit is capable of operating the switching of the inflation/deflation sources in the periodic cyclic timing sequence described herein with reference to FIGS. 1, 2 in particular although other timing sequences can be utilised.

Figure 5:
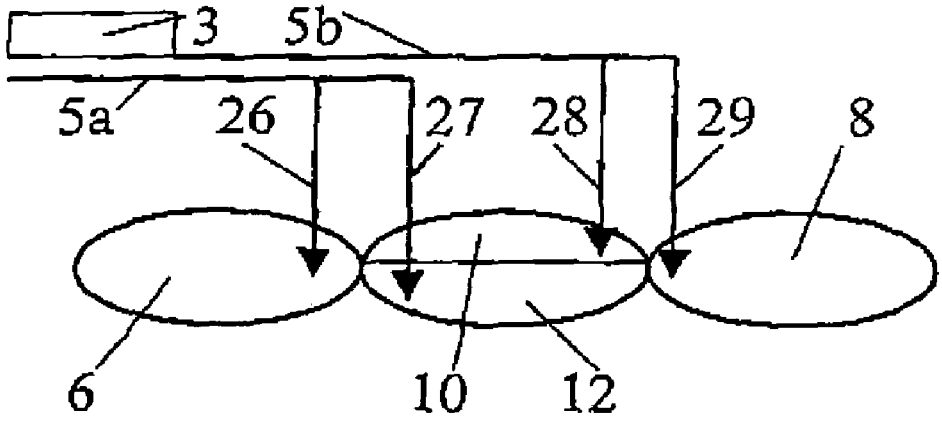
FIG. 5 is a schematic sectional view along line A to A of FIG. 6 of another embodiment of a medical apparatus embodying the present invention including an inflatable neck support pillow.
Figure 6:
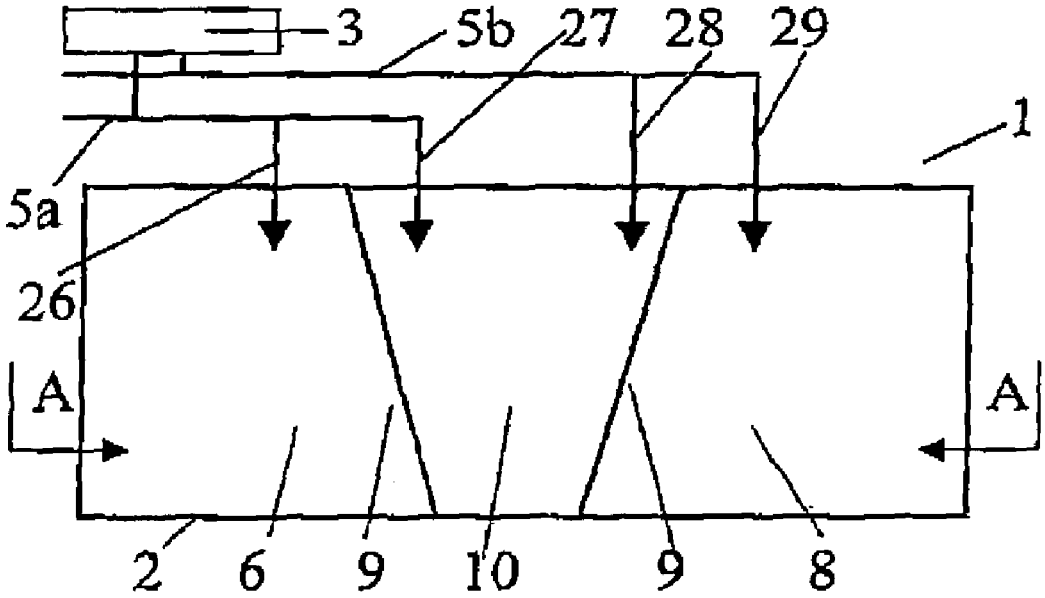
FIG. 6 is a schematic plan view of the inflatable neck support pillow of FIG. 5.
Figure 9:
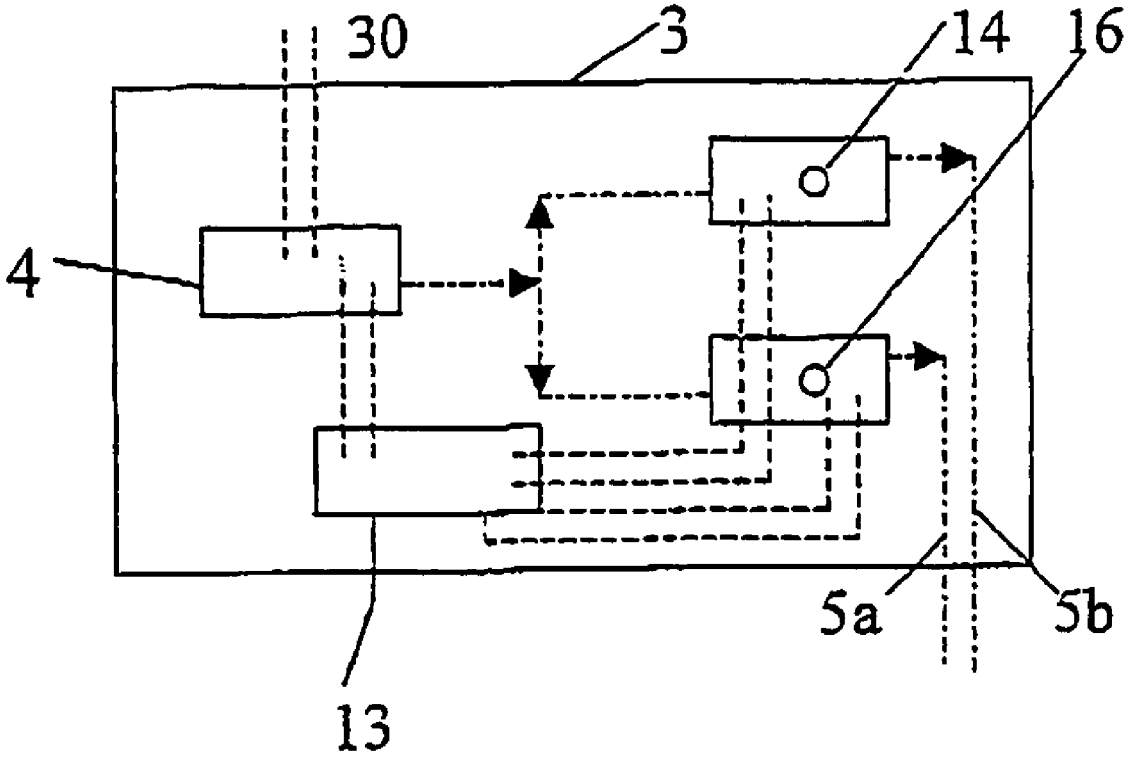
FIG. 9 is a schematic view of electrical control circuitry for use with each of the embodiments of FIGS. 5 and 6, and FIG. 7 to 8.

Referring to FIGS. 5, 6 and 9, there is disclosed yet another embodiment of a medical apparatus in accordance with the present invention which operates in a similar manner to the embodiment described above with reference to FIGS. 1 and 2. However, in this embodiment the two tubular air pipes 5*a*, 5*b* are each divided into two sub-channels 26, 27 and 28, 29, respectively, with air pipe 26 coupled directly to volume 6; air pipe 27 coupled directly to volume 12; air pipe 28 coupled directly to volume 10; and air pipe 29 coupled directly to volume 8.

Such connections as are just described allow the pillow to operate in an substantially identical manner to the pillow described with regard to FIGS. 1 and 2 with only two controlled air pipes but without the air bleed connections 5*c*, 5*d* between volumes 6 and 12, and 8 and 10, respectively. Furthermore, the pillow is cheaper to manufacture because of the removal of the need to insert a special slit bleed valve through the seam between appropriate volumes or insert a bleed tube or ring tube as previously disclosed.

Figure 7:
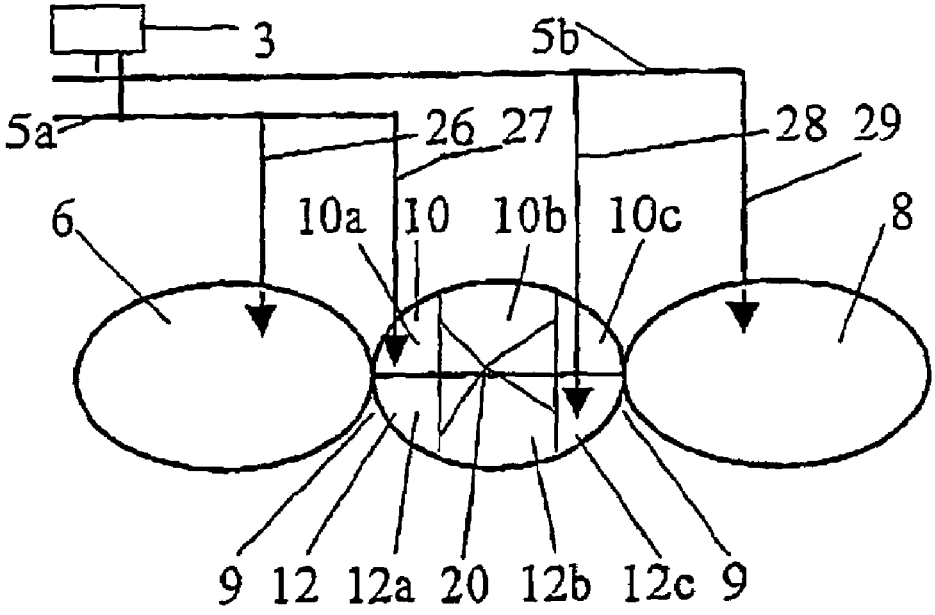
FIG. 7 is a schematic cross-sectional view of an inflatable back pillow of FIG. 8.
Figure 8:
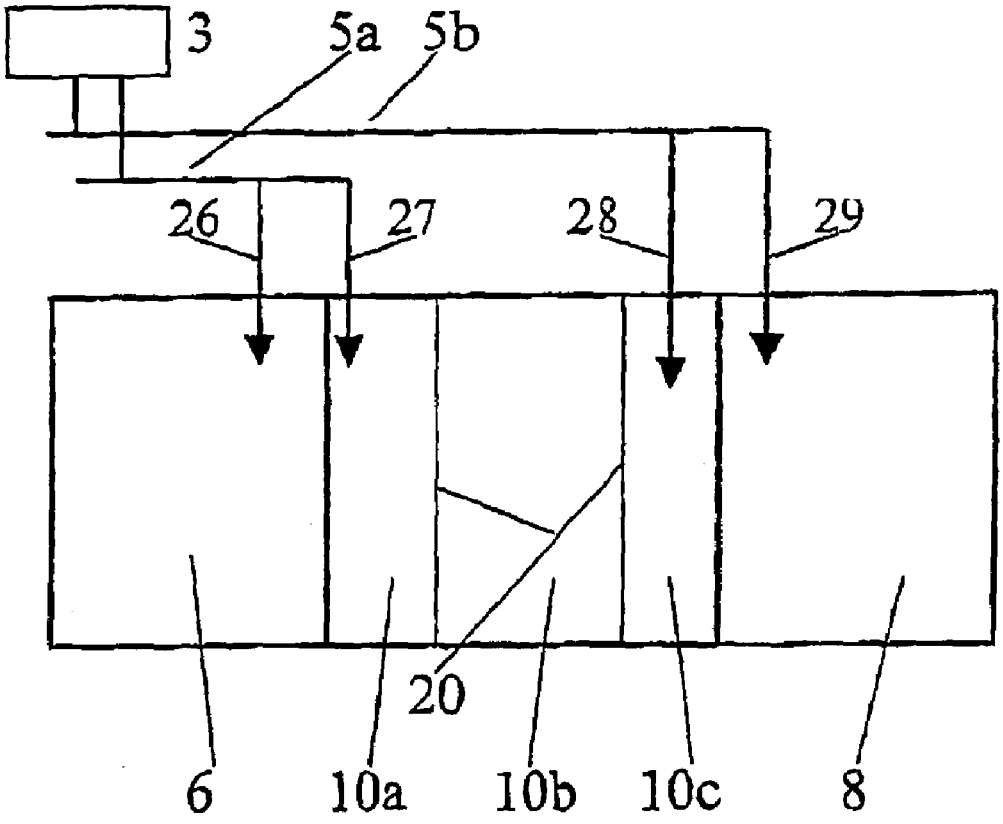
FIG. 8 is a schematic plan view of the support pillow of FIG. 7.

FIGS. 7, 8 and 9 illustrate a further embodiment of a medical apparatus in accordance with the present invention which is substantially identical in constructions and in operation as that described above with regard to FIGS. 3 and 4. The apparatus may include height restrictors in central volumes 10, 12 to restrict the height of those volumes but allow fluid to pass throughout the respective volume. Otherwise, the two channel inputs 5*a*, 5*b* each divide into two sub-channels or paths 26, 27 and 28, 29 coupled with volumes 6, 12, 10, 8, respectively. Such apparatus operates with a similar operative cycle to that of FIGS. 1 to 6 and has the same advantages as given with reference to FIGS. 5 and 6 above.

In either of the embodiments described with reference to FIGS. 5 and 6 or 7 and 8 it is possible to include directional flow restrictors in each of the sub-channels 26–29 to control the amount of fluid entering the volumes 6, 12, 10, 8 so as to achieve the required nodding and side-to-side motion. The restrictor in say sub-channel 26 can allow a different flow rate of fluid than the restrictor in sub-channel 27 to more accurately control the point at which said nodding stops and starts and when side-to-side motion stops and starts.

The fluid inflation device 3 of FIGS. 1 to 8 is shown in more detail in FIG. 9 where the device 3 has an electrical mains supply input 30 connected with air pump 4 which is also connected with electronic timer 13 which controls the length of the inflation/deflation cyclic operating program when the pump 4 is operated continuously. The pump 4 is also connected with each of electronic solenoid air control valves 14, 16 which are in turn connected with the electronic timer to ensure electrical power is directed to the respective control valves at the appropriate times. At those times air is passed along a respective output of the control valves 14, 16 to inflate a respective pair of volumes 6, 12; 8, 10.

Although the embodiments herein have been described in regard to the use of air any appropriate fluid (gas or liquid) can be utilised.

There has thus been disclosed a number of different embodiments having the common concept of controlling various volumes of a pillow or support cushion to obtain nodding and/or side-to-side movement so that the head can be therapeutically manipulated. Whilst the invention has been described by reference to embodiments for the relief of neck pain, the invention is applicable also to the relief of back pain and the same embodiments, possibly, with dimensional changes, could be adapted to this function.

The embodiments of the invention hereinbefore described are in all respects exemplary only and modifications and variations thereto could be effected without departure from the scope of the invention as set forth in the appended claims.

The invention claimed is:

1. A medical apparatus comprising:

an inflatable/deflatable support for manipulating the spine of a patient, wherein the support comprises:

an inflatable central volume divided in to two compartments stacked one on top of the other; and one or more other volumes adjoining the central volume on on at least one of three lateral sides of the central volume, and a fluid pump connected with the support, wherein said fluid pump comprises a two channel inflation/deflation coupling for inflating said central volume and said one or more other volumes, said two channel inflation/deflation coupling being arranged to control periodic cyclic movement of a portion of the patient relative to the rest of the patient with a fore-and-aft and/or side-to-side motion by selective inflation/deflation of said two compartments of said central volume and said one or more other volumes, whereby said central volume and said one or more other volumes are arranged to cause opposing bone surfaces of the spine to move relative to each other.

2. An apparatus as claimed in claim 1, wherein the support comprises upper and lower panels which are sealed to each other.

3. An apparatus as claimed in claim 2, wherein the upper and lower panels of the support are secured to each other so as to define inflatable volumes.

4. An apparatus as claimed in 3, wherein the portion of the patient is the head and the one or more other volumes adjoining the central volume are arranged to be alternately inflated and deflated in addition to cyclical inflation and deflation of the central volume, so that the patient's head can undergo a side-to-side rocking movement and/or a nodding movement when the apparatus is in use.

5. An apparatus as claimed in claim 1, wherein the one or more other volumes are fluidly interconnected with the central volume so that the one or more other volumes can be inflated via a single orifice.

6. An apparatus as claimed in claim 1, comprising two fluid control inputs with each input connected to inflate at least two volumes among said central volume and said one or more other volumes.

7. An apparatus as claimed in claim 6, wherein one or more of the fluid control inputs is divided into a plurality of sub inputs each sub input being connected to a respective one of the at least two volumes among said central volume and said one or more other volumes.

8. An apparatus as claimed in claim 1, comprising an electronic timer for controlling selective inflation/deflation of said two compartments and said one or more other volumes.

9. An apparatus as claimed in claim 1, comprising a rotor/stator arrangement for controlling selective inflation/deflation of said two compartments and said one or more other volumes.

10. An apparatus as claimed in claim 9, wherein the rotor/stator arrangement cyclically interconnects said fluid pump to said two compartments of said central volume or to said one or more other volumes.

11. An apparatus as claimed in claim 1, wherein the inflatable/deflatable support is a pillow.

12. An apparatus as claimed in claim 1, wherein the electronic timer is programmed to periodically, cyclically control inflation/deflation of the apparatus.

13. A medical apparatus for the relief, treatment and or prevention of pain experienced by a patient at the neck or spine, the apparatus comprising:

a pillow arranged to be interpositioned between a patient's head and a head rest, and a fluid source having a two channel input arranged to periodically supply fluid to and void fluid out of a central volume in the pillow, the central volume being divided into two compartments stacked one on top of the other, and the fluid being deliverable to one or more peripheral inflatable volumes of the pillow outward of the central volume so as to cause a person's head to move in a cyclic manner with a nodding or side-to-side motion relative to the rest of the patient by selective inflation/deflation of said two compartments or said one or more peripheral inflatable volumes, wherein said central volume or said one or more peripheral inflatable volumes are arranged to cause opposing bone surfaces of the spine to move relative to each other via said selective inflation/deflation of said central volume or said one or more peripheral inflatable volumes.

14. A method for manipulating the spine of a patient, the method comprising:

(i) providing an inflatable pillow having a lateral dimension and a superior-inferior dimension shorter than the lateral dimension, the pillow comprising:

a central inflatable volume;

two other volumes arranged along the lateral dimension and adjoining the central volume on two sides of the central volume; and a fluid pump connected with the pillow, said fluid pump comprising a two-channel inflation/deflation coupling for inflating said central volume and said two other volumes;

(ii) positioning the pillow between the spine of the patient and a supporting surface with the spine transverse to the lateral dimension of the pillow, such that a first portion of the spine rests on the pillow and a second portion of the spine rests on the supporting surface; and (iii) periodically, cyclically inflating the central volume and the two other volumes to produce fore-and-aft and side-to-side movement of the first portion of the spine relative to the second portion of the spine to cause opposing bone surfaces of the spine to move relative to each other.

15. A method as claimed in claim 14, comprising inflating/deflating a pillow constituting the support, wherein the portion of the patient is the head.

16. A method as claimed in claim 14, including controlling an inflation/deflation cycle by operating a rotor/stator arrangement.

17. A method as claimed in claim 14, comprising operating an electronic timer to control periodic cyclic inflation/deflation a pillow constituting the support.

18. A medical apparatus comprising an inflatable/deflatable pillow for manipulating the spine of a patient, the pillow having a lateral dimension and a superior-inferior dimension shorter than the lateral dimension, such that when placed beneath the spine with the spine transverse to the lateral dimension, the pillow acts on less than the full length of the spine, the pillow comprising:

an inflatable central volume and two other volumes arranged along the lateral dimension and adjoining the central volume on two sides of the central volume; and a fluid pump connected with the pillow, said fluid pump being arranged to control periodic cyclic movement of a first portion of the spine resting on the pillow with fore-and-aft and side-to-side motion by selective inflation/deflation of said central volume and said two other volumes, wherein said fluid pump comprises a two-channel inflation/deflation coupling for inflating said central volume and said two other volumes, whereby said central volume and said two other volumes are arranged to cause opposing bone surfaces of the spine to move relative to each other.

19. The medical apparatus of claim 18, wherein the central volume is divided into two compartments stacked one on top of the other.

20. The method of claim 18, wherein:

the central volume is divided into two compartments stacked one on top of the other; and periodically, cyclically inflating the central volume and the two other volumes comprises periodically, cyclically performing the following steps:

inflating a first one of the two compartments;

subsequently inflating a first one of the two other volumes;

subsequently inflating a second one of the two compartments; and subsequently inflating a second one of the two other volumes.

* * * * *